United States Patent [19]

Roscoe

[11] Patent Number: 4,723,871

[45] Date of Patent: Feb. 9, 1988

[54] INEXPENSIVE HEADWALL FOR CULVERTS

[76] Inventor: Duane Roscoe, 220 Brook Blvd., Quinton, Va. 23141

[21] Appl. No.: 48,556

[22] Filed: May 11, 1987

[51] Int. Cl.[4] ..... E01F 5/00

[52] U.S. Cl. ..... 405/125; 405/124

[58] Field of Search ..... 405/124, 125, 126, 127, 405/284, 286, 287; 249/10, 11, 12

[56] References Cited

U.S. PATENT DOCUMENTS

| | | | |
|---|---|---|---|
| 701,034 | 5/1902 | Gray | 405/124 |
| 980,754 | 1/1911 | Brannen | 405/125 |
| 1,098,766 | 6/1914 | Scully et al. | 405/125 |
| 1,130,508 | 3/1915 | Hall | 405/125 |
| 1,212,452 | 1/1917 | Caldwell | 405/125 |
| 1,407,246 | 2/1922 | Bond | 249/12 |
| 1,926,633 | 9/1933 | Scott | 249/12 |
| 3,735,595 | 5/1973 | Watkins | 405/124 |
| 3,779,021 | 12/1973 | Green | 405/125 |
| 4,595,314 | 6/1986 | Lockwood | 405/125 |
| 4,605,338 | 8/1986 | Peterson | 405/124 |

*Primary Examiner*—David H. Corbin

*Attorney, Agent, or Firm*—Norman B. Rainer

[57] ABSTRACT

A shell-like retainer structure is provided for forming headwalls at each extremity of a culvert disposed below a driveway. The retainer structure has two parallel spaced apart sidewalls having aligned U-shaped openings, and a transverse wall spanning the perimeters of said side walls, said side and transverse walls defining a chamber which opens at the bottom of the retainer structure and at the U-shaped openings. A filling aperture is located in the uppermost extremity of the transverse wall. When the retainer structure is seated upon the culvert, filling material is poured through the aperture, and the filled structure is left in place upon the culvert.

7 Claims, 6 Drawing Figures

INEXPENSIVE HEADWALL FOR CULVERTS

BACKGROUND OF THE INVENTION

This invention relates to a headwall as employed with concrete culvert pipe, and more particularly concerns a device which serves as a precursor for the in situ fabrication of such headwalls.

In constructing a driveway which will joint perpendicularly with a roadway bordered by drainage ditches, a series of large diameter interengaging concrete culvert pipes is generally placed in the ditch, forming a bridge for the overlying driveway surface while permitting unobstructed flow of storm water in the ditch. At each extremity of the series of pipes, a headwall is generally installed in perpendicular disposition to the axis of the pipes. The headwall functions to stabilize the position of the pipes, to prevent errosion of soil from regions adjacent the pipe openings, and to provide a border for the driveway at the extremities of the pipes.

The formation of such headwalls has generally been achieved by brickwork or by constructing wooden forms at the pipe extremities for receiving poured concrete, and removing the forms after the concrete has hardened. Such techniques are costly and time consuming. U.S. Pat. No. 3,779,021 to Green discloses a plastic form into which concrete is poured to produce a headwall. Although the Green Patent minimizes the amount of labor required in constructing a form or mold, it still requires that concrete be available and poured at the construction site. In addition to cost considerations, concrete and facilities for its transportation and handling may not be available at certain construction sites. The headwall of Green also requires that the culvert penetrate an aperture in the plastic form. Such manipulation can be difficult in certain situations.

It is accordingly an object of the present invention to provide a device for quickly and easily forming a headwall without requisite use of concrete.

It is another object of this invention to provide a device as in the foregoing object which does not require penetration by the culvert.

It is a further object of the present invention to provide a device of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a headwall retainer structure comprised of:

(a) two identical sidewalls in spaced apart parallel alignment, each having a substantially U-shaped configuration with opposed leg portions adapted to be downwardly directed and having horizontally disposed lower edge extremities, a U-shaped opening centered in the sidewall and having a semi-circular upper boundary which merges tangentially with straight vertical side boundaries constituting facing interior edge extremities of said leg portions, and an outer perimeter having an upper section disposed above said opening and vertical side sections constituting exterior edge extremities of said leg portions, (b) a transverse wall extending between the perimeter edges of the two sidewalls, thereby defining with said sidewalls a chamber which is open at the lower edge extremities of the leg portions and within the U-shaped opening, (c) a filling aperture in the upper section of said transverse wall, and (d) spacer struts extending perpendicularly between said sidewalls in the regions of said opening and the lower extremities of said legs, (e) said retainer structure having a first vertical plane of symmetry that perpendicularly intersects said sidewalls midway between said leg portions.

In preferred embodiments of the invention, the sidewalls are substantially flat on both surfaces, a removable plug is associated with the filling aperture, the upper section of the perimeter of the sidewalls is rounded to parallel the curvature of the upper boundary of the U-shaped opening, and the transverse wall is rounded convexly away from the cavity. Reinforcing vanes may be incorporated into the facing surfaces of the sidewalls.

In use, a pair of the retainer structures are emplaced upon the extremities of the culvert pipe by a vertical downward movement so that the lower extremities of the leg portions are in firm abutment with the underlying ground or wet concrete footing and the upper boundary of the U-shaped opening is in abutment with the culvert pipe, whereby said chamber becomes substantially closed. The chamber is then filled through said filling aperture with a granular material or a flowable material capable of solidifying within the chamber. The filled retainer structures are left in place on the culvert.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
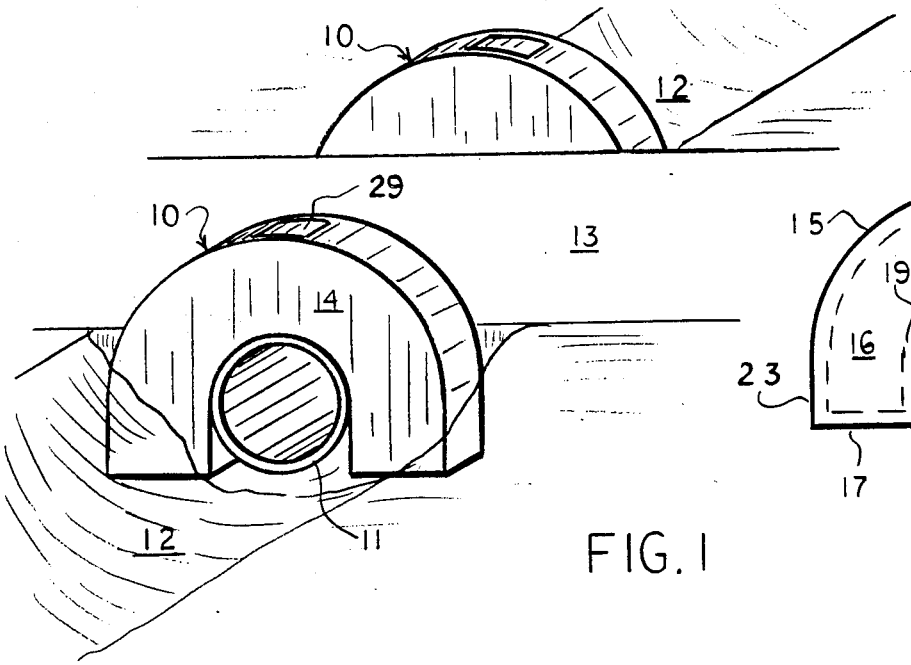
FIG. 1 is a perspective view showing two identical retainer structures of this invention in functional association with culvert pipe and a driveway.
Figure 2:
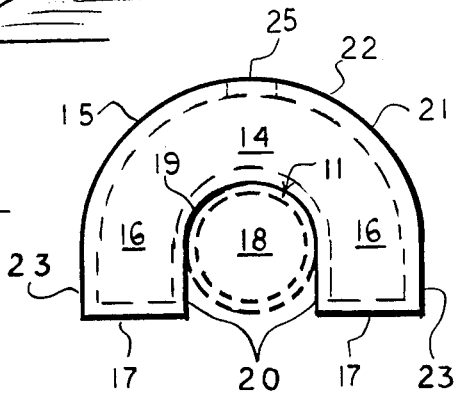
FIG. 2 is a side view of the retainer structure of FIG. 1.
Figure 3:
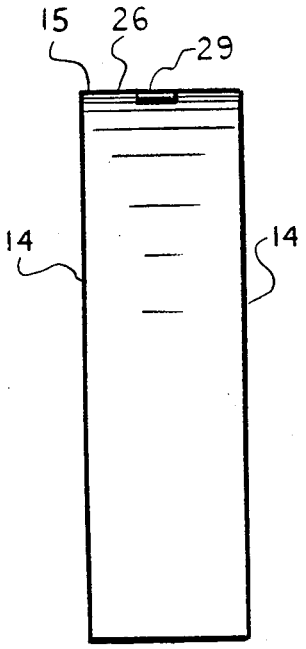
FIG. 3 is an enlarged end view thereof.
Figure 4:
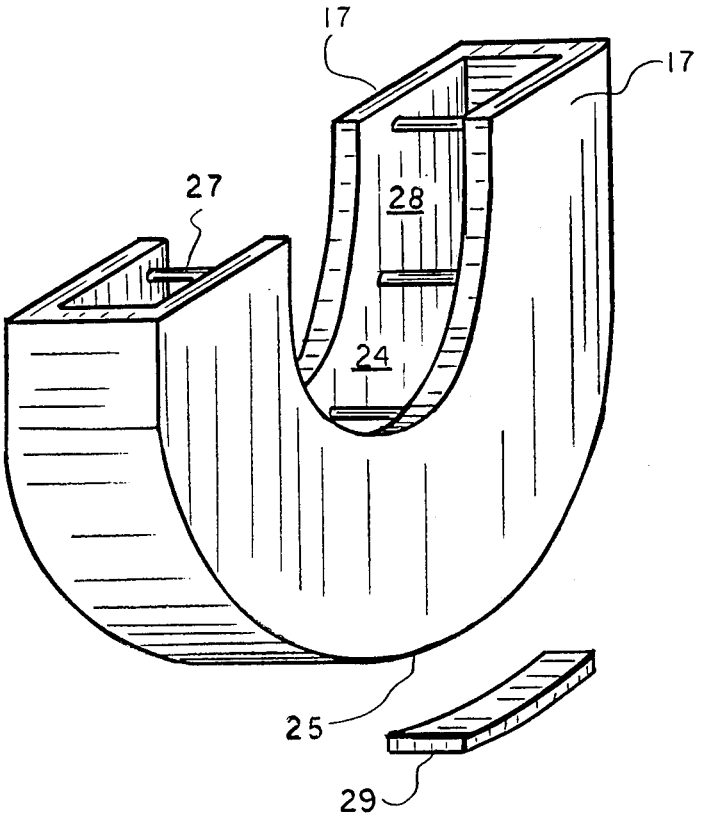
FIG. 4 is an inverted perspective view thereof showing a plug in exploded relationship.

The terms "interior" and "exterior" and expressions of similar import as used in this specification will have reference to the geometric center of the retainer structure as shown in FIG. 1.

DESCRIPTION OF THE PREFERRED EMBODIMENT

Referring to the drawing, an embodiment of the retainer structure 10 of this invention is shown in functional engagement with a culvert pipe 11 disposed within drainage ditch 12 below driveway 13.

The retainer structure is a substantially monolithic shell structure fabricated by a molding operation utilizing a resin such as polyethylene, plasticized polyvinyl chloride or resins of equivalent properties, and comprised of two sidewalls 14 in spaced apart parallel alignment, and transverse wall 15 which joins said sidewalls.

The sidewall has a substantially U-shaped configuration having opposed leg portions 16 adapated to be downwardly directed and terminating in horizontally disposed lower edges 17.

A U-shaped opening 18 is centered in the sidewall, said opening having a semi-circular upper boundary 19 which merges tangentially with straight vertical side boundaries 20 which constitute facing interior edge extremities of said leg portions. The sidewall is further characterized in having outer perimeter 21 comprised of upper section 22 disposed above opening 18, and vertical side sections 23 constituting exterior edge extremities of said leg portions.

Transverse wall 15 extends between the outer perimeter edges of the facing sidewalls, thereby defining with said sidewalls a chamber 24 which is open at the lower edge extremities of the leg portions and within the U-shaped opening.

A filling aperture 25 is located within upper section 26 of said transverse wall. Spacer struts 27 extend perpendicularly between the facing interior surfaces 28 of said sidewalls in bolted or molded engagement therewith. The spacer struts prevent the sidewalls from deforming outwardly after filling of the chamber. Upraised reinforcing ridges may be disposed upon said facing surfaces. The exterior surfaces of the retainer structure may be provided with ornamentation such as simulated brickwork. A plug 29 is provided to seal aperture 25 after emplacement and filling of the retainer structure.

Figure 5:
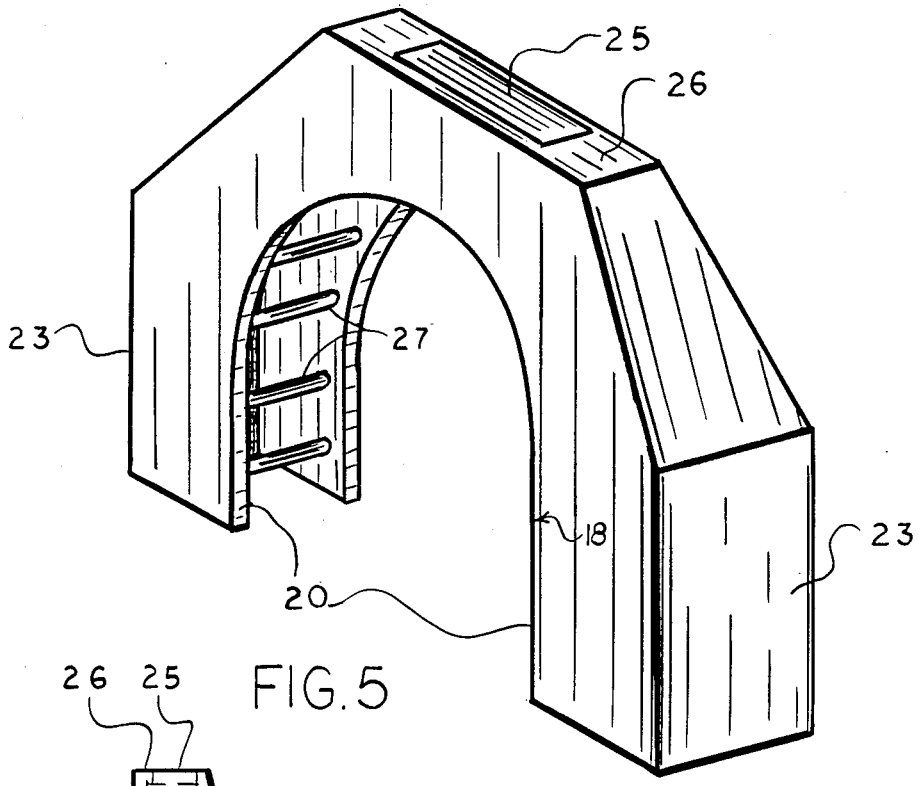
FIG. 5 is a perspective view of an alternative embodiment of retainer structure of this invention.
Figure 6:
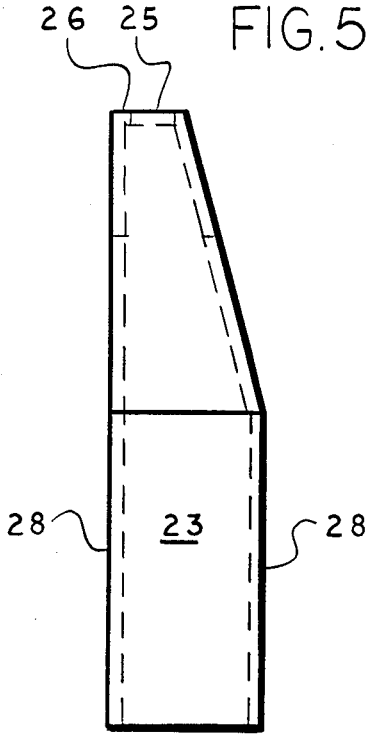
FIG. 6 is an end view of the embodiment of FIG. 5.

The embodiment of the retainer structure shown in FIGS. 5 and 6 has a large side wall and an opposed smaller sidewall. The large sidewall is adapted to face the driveway. In view of such construction, this embodiment has a more unobtrusive appearance, and can be made in smaller size without impairment of its functionality.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A headwall retainer structure comprised of:

(a) two sidewalls in spaced apart parallel alignment, each having a substantially U-shaped configuration with downwardly directed opposed leg portions and having horizontally disposed lower edge extremities, a U-shaped opening centered in the sidewall and having a semi-circular upper boundary which merges tangentially with straight vertical side boundaries constituting facing interior edge extremities of said leg portions, and an outer perimeter having an upper section disposed above said opening, and vertical side sections constituting exterior edge extremities of said leg portions, (b) a transverse wall extending between the perimeter edges of the two sidewalls, thereby defining with said sidewalls a chamber which is open at the lower edge extremities of the leg portions and within the U-shaped opening, (c) a filling aperture in the upper section of said transverse wall, and (d) spacer struts extending perpendicularly between said sidewalls adjacent said U-shaped opening and adjacent the lower extremities of said legs, (e) said retainer structure having a first vertical plane of symmetry that perpendicularly intersects said sidewalls midway between said leg portions.

2. The headwall of claim 1 fabricated from plastic as a substantially monolithic structure.

3. The headwall of claim 1 having a second vertical plane of symmetry located midway between said sidewalls and parallel thereto, and which perpendicularly intersects said first plane of symmetry.

4. The headwall of claim 1 wherein the sidewalls are substantially flat on both surfaces.

5. The headwall of claim 1 wherein a removable plug is associated with the filling aperture.

6. The headwall of claim 1 having reinforcing vanes incorporated into the facing interior surfaces of the sidewalls.

7. A circular cylindrical culvert disposed transversely below a driveway, each extremity of said culvert having seated thereupon a headwall of claim 1 in embracing relationship with said driveway.

* * * * *